US007677557B2

(12) United States Patent
Ino

(10) Patent No.: US 7,677,557 B2
(45) Date of Patent: Mar. 16, 2010

(54) SHEET DISCHARGING APPARATUS AND IMAGE FORMING APPARATUS

(75) Inventor: Kazushi Ino, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 496 days.

(21) Appl. No.: 11/534,282

(22) Filed: Sep. 22, 2006

(65) Prior Publication Data

US 2007/0069454 A1 Mar. 29, 2007

(30) Foreign Application Priority Data

Sep. 28, 2005 (JP) ..... 2005-282424

(51) Int. Cl.
*B65H 31/26* (2006.01)

(52) U.S. Cl. ..... 271/220; 271/207

(58) Field of Classification Search ..... 271/207, 271/220, 176

See application file for complete search history.

(56) References Cited

U.S. PATENT DOCUMENTS 5,033,731 A * 7/1991 Looney ..... 271/176
5,284,337 A * 2/1994 Ettischer et al. ..... 271/220
5,346,203 A * 9/1994 Stemmle ..... 271/288
2003/0160385 A1* 8/2003 Furusawa ..... 271/220
2004/0022567 A1* 2/2004 Fukatsu et al. ..... 399/405

FOREIGN PATENT DOCUMENTS

JP 2001-34021 2/2001

* cited by examiner

*Primary Examiner*—Patrick H Mackey
*Assistant Examiner*—Thomas A Morrison
(74) *Attorney, Agent, or Firm*—Fitzpatrick, Cella, Harper & Scinto

(57) ABSTRACT

The sheet discharging apparatus for discharging sheets to a stacking portion by a discharging portion, including an opening/closing member openable and closable with respect to a main body of the apparatus; a lever member rotatably provided on the opening/closing member above the stacking portion and capable of taking a suspended posture by an own weight of the lever member in a position where the opening/closing member is closed; and a delay mechanism which delays a rotation of the lever member toward the suspended posture caused by the own weight of the lever member, when the opening/closing member is shifted from an open position to a closed position. It can be prevented from being caught by the sheet when the upper cover is opened and closed.

18 Claims, 11 Drawing Sheets

SHEET DISCHARGING APPARATUS AND IMAGE FORMING APPARATUS

BACKGROUND OF THE INVENTION

1. Field of the Invention

The present invention relates to a sheet discharging apparatus used in an image forming apparatus such as, for example, a copier, a printer, a facsimile and the like and an image forming apparatus having such a sheet discharging apparatus, and more particularly, it relates to a compact sheet discharging apparatus having good operability and an image forming apparatus having such a compact sheet discharging apparatus.

2. Description of the Related Art

Recently, in image forming apparatuses such as printers, copiers and the like, needs for miniaturizing a main body or frame of the image forming apparatus have particularly been increased. Particularly, in a color image forming apparatus, since an image forming portion tends to become bulky, compactness thereof has been requested strongly.

Further, regarding operability of the main body of the image forming apparatus, particularly, needs for improving a jam treatment ability and exchangeability of a process cartridge has been increased, and thus, it is very important to perform such operations by one-action.

In order to satisfy such requirements, for example, in a color image forming apparatus described in Japanese Patent Application Laid-Open No. 2001-34021, as shown in FIG. 9, process cartridges Y, M, C and K capable of forming respective color images are arranged in an up-and-down (vertical) direction and the jam treatment and the exchanging of the process cartridge can be facilitated by opening a front cover 100. Further, the jam treatment in a fixing portion and a sheet discharging portion can be performed by opening an upper cover 101. In this way, by providing a front-operation structure in which the jam treatment and the exchanging of the process cartridge can be completed only at a front side of the main body of the image forming apparatus, the operability of the operator can be improved.

However, since the plurality of process cartridges are arranged in the vertical direction, there arises a problem that a height of the main body of the apparatus becomes relatively great, and thus, a technique for reducing such height as less as possible is required.

To this end, it is considered to design an arrangement in which a discharged sheet full-stacked condition detecting portion does not affects an influence upon the height of the main body by attaching a lever member 102 constituting the discharged sheet full-stack condition detecting portion for the sheets discharged on a discharge tray 103 to the opening/closing upper cover 101.

However, in the above-mentioned arrangement, if the sheets are stacked up to a substantially full-stack condition, for example as shown in FIG. 9, when the upper cover 101 supported by an L-shaped arm 105 rotatable around an rotation axis 104 tries to be closed, the lever member 102 may be caught by the stacked sheets. As shown in FIG. 10, when the lever member 102 is lowered by its own weight, the lever member is locked by a stopper (not shown) provided on the upper cover 101, thereby preventing a further rotation of the lever member in an anti-clockwise direction. The reason is that, when a sheet P1 is discharged from the main body of the image forming apparatus, an angle between the lever member 102 and the upper cover 101 is maintained to a predetermined angle range to prevent the buckling of the sheet even if a leading end of the sheet P1 abuts against the lever member 102.

Further, since the rotation axis 104 of the upper cover 101 does not coincide with a rotation center of the lever member 102, the following influences occur. That is to say, as shown in FIGS. 11A to 11C, from a condition that the upper cover 101 is opened, as the upper cover is closed, due to the rotation of the upper cover 101, the lever member 102 is shifted obliquely and downwardly to approach a pair of discharge rollers 106. Further, from the condition that the upper cover 101 is opened, as the upper cover is closed, the lever member 102 remains in a suspended condition halfway due to its own weight (see FIGS. 11A and 11B). However, when the lever member 102 is engaged by the stopper of the upper cover 101, the lever member 102 is lifted by the stopper to be rotated together with the upper cover 101 (see FIG. 11B). In this case, as shown in FIG. 11C, a leading end of the lever member 102 may be caught by the sheet stack P1 not to permit the closing of the upper cover.

SUMMARY OF THE INVENTION

A purpose of the present invention is to provide a compact sheet discharging apparatus having good operability and an image forming apparatus having such a sheet discharging apparatus, in consideration of the above-mentioned circumstances.

Another purpose of the present invention is to prevent a lever member from being caught when an opening/closing member is opened and closed, by providing a delay mechanism for delaying a rotation of the lever member toward its suspended posture attained by its own weight.

A further purpose of the present invention is to miniaturize the apparatuses by providing a lever member on an opening/closing member.

A further purpose of the invention is to provide a sheet discharging apparatus for discharging sheets to a stacking portion by a discharging portion, including an opening/closing member openable and closable with respect to a main body of the apparatus; a lever member rotatably provided on the opening/closing member above the stacking portion and capable of taking a suspended posture by an own weight of the lever member in a position where the opening/closing member is closed; and a delay mechanism which delays a rotation of the lever member toward the suspended posture caused by the own weight of the lever member, when the opening/closing member is shifted from an open position to a closed position.

A still further purpose of the present invention will become apparent from the following description of exemplary embodiments with reference to the attached drawings.

DESCRIPTION OF THE EMBODIMENTS

Now, a sheet discharging apparatus and an image forming apparatus having such a sheet discharging apparatus according to each of embodiments according to the present invention will be concretely described with reference to the attached drawings.

First Embodiment

FIGS. 1 to 5C show an image forming apparatus having a sheet discharging apparatus according to a first embodiment of the present invention. Incidentally, in the first embodiment, a color image forming apparatus of electro-photographic type is shown exemplarily.

(Image Forming Apparatus)

Figure 1:
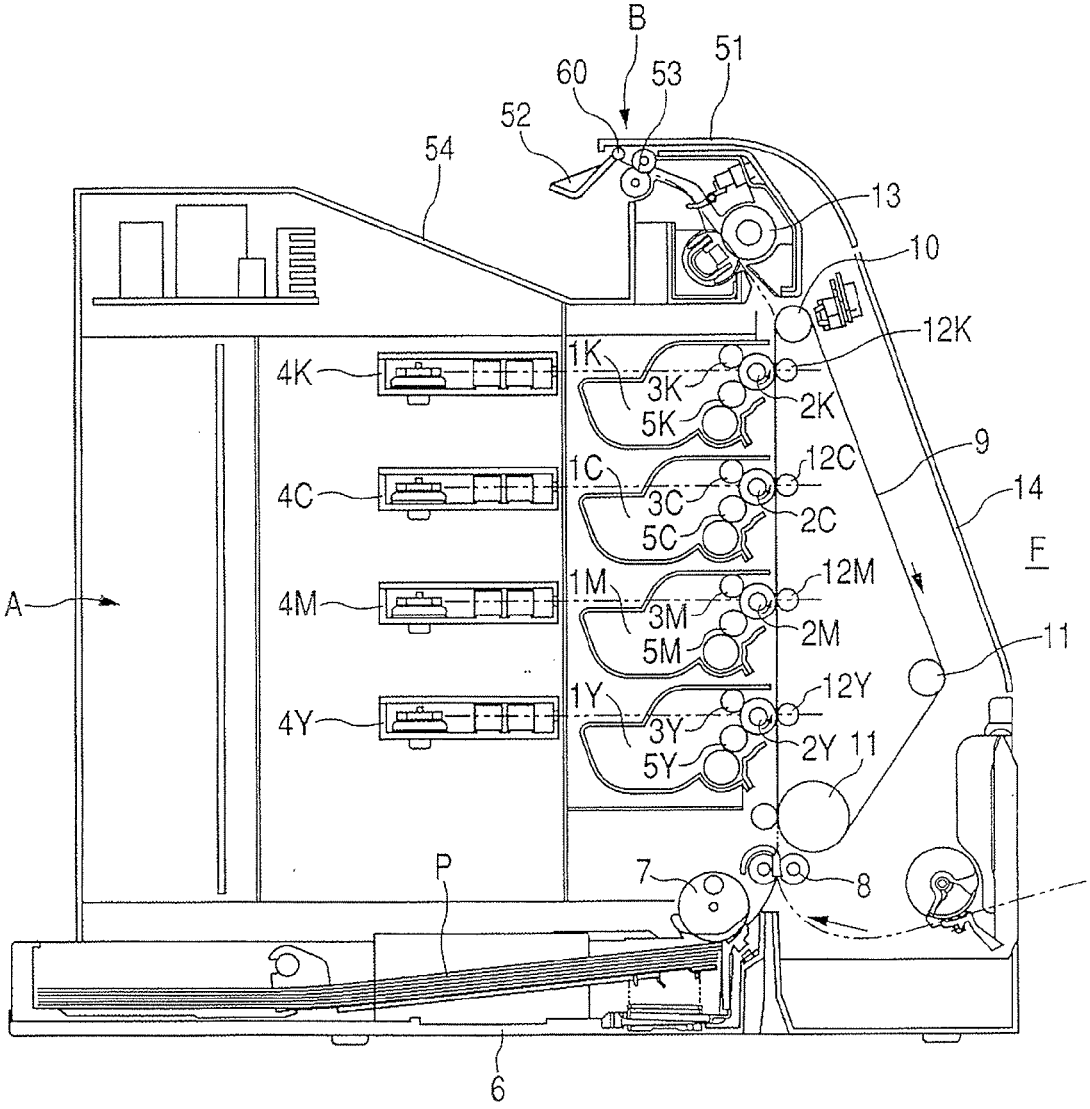
FIG. 1 is a schematic sectional view showing the entire main body of a color image forming apparatus according to a first embodiment of the present invention.
Figure 2:
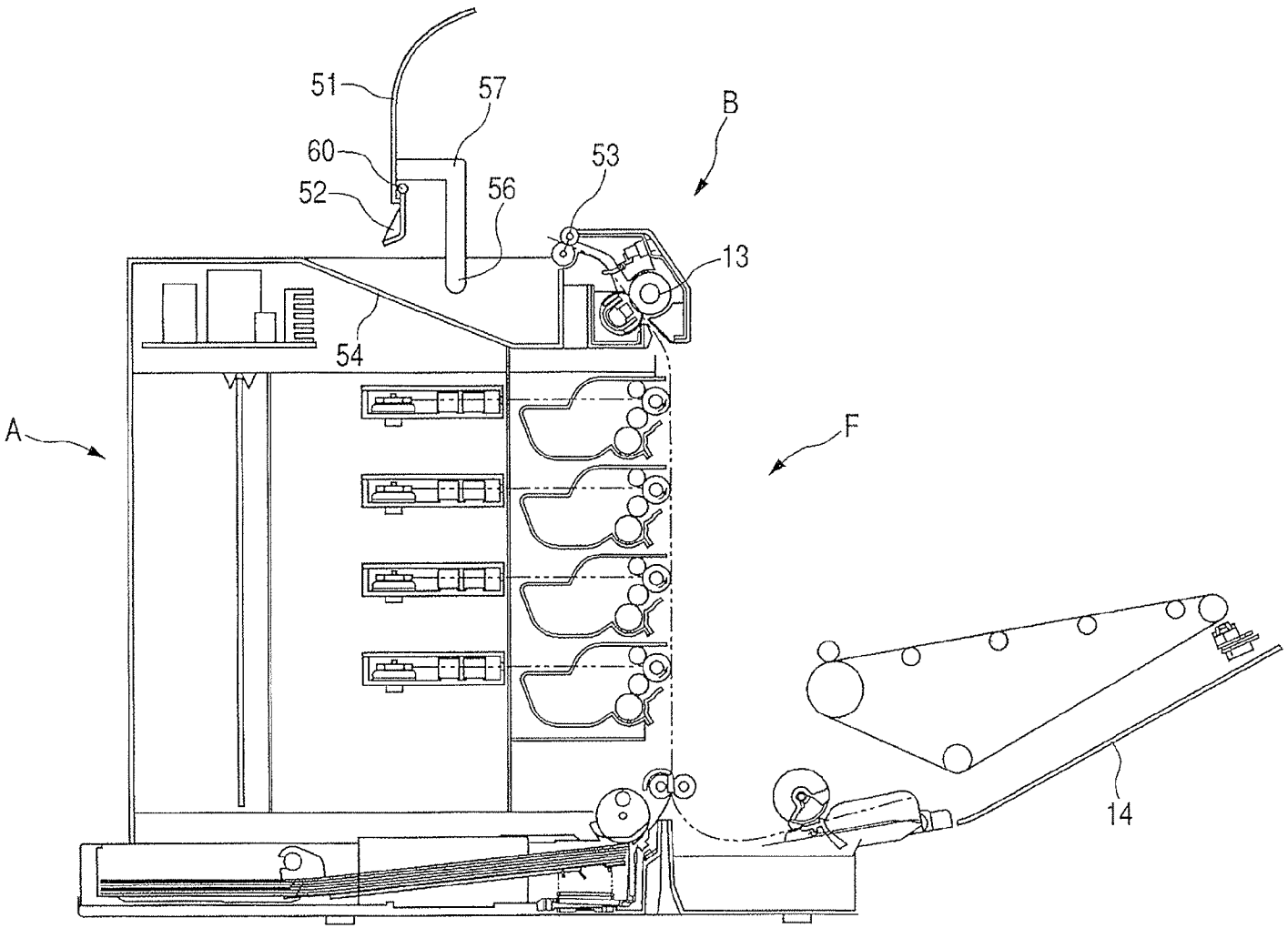
FIG. 2 is a schematic sectional view showing a condition obtained when an opening/closing cover of the main body of the color image forming apparatus according to the first embodiment of the present invention is opened.

First of all, the entire construction of an image forming apparatus will be described with reference to FIGS. 1 and 2. Incidentally, FIG. 1 is a schematic sectional view for explaining the entire construction of the image forming apparatus and FIG. 2 is a sectional view for explaining the image forming apparatus in a condition that a front cover is opened.

In an image forming apparatus A according to the first embodiment, a plurality of image forming portions each for forming an image on a sheet are arranged in an up-and-down (vertical) direction; i.e. four image forming portions for forming yellow (Y), magenta (M), cyan (C) and Black (K) toner images, respectively, are arranged from below in order along the vertical direction. The respective image forming portions have the same constructions, except for colors of toners used in development.

The image forming portions include process cartridges 1 (1Y, 1M, 1C and 1K) which can be detachably mounted to a main body of the image forming apparatus. The process cartridges 1 includes respective rotatable photosensitive drums 2 (2Y, 2M, 2C and 2K) each of which is rotatably driven by a drive motor and a driving force transmitting unit (both are not shown). A surface of each photosensitive drum 2 is uniformly charged by applying charging bias to a corresponding charging roller 3 (3Y, 3M, 3C and 3K). Then, the surface of the drum is selectively exposed by a laser beam emitted from a corresponding laser scanner device 4 (4Y, 4M, 4C and 4K) as an exposure device, thereby forming an electrostatic latent image on the drum surface. Respective color toners are applied to the respective electrostatic latent images, so that the latent images are developed as toner images.

Sheets P are stacked in a feeding cassette 6. After the sheet P is picked-up and fed by a drive motor and a driving force transmitting unit (both are not shown) driven at a predetermined timing, the sheet is conveyed to a conveying belt 9 through a pair of registration rollers 8. The conveying belt 9 is supported by a drive roller 10 and driven rollers 11 so that the belt is rotatingly driven in a clockwise direction shown in FIG. 1 while contacting with the photosensitive drums 2. When the sheet P electrostatically stuck to the conveying belt 9 is being conveyed while contacting with the photosensitive drums 2, transferring biases are applied to transferring rollers 12 (12Y, 12M, 12C and 12K), with the result that the toner images on the photosensitive drums 2 are transferred onto the sheet P.

Then, the sheet P to which the four color toner images were transferred is conveyed into a fixing device 13, where the sheet is heated and pressurized to fuse and fix the toner images onto the sheet. Thereafter, the sheet is discharged out of the main body of the apparatus by means of a sheet discharging apparatus B.

In the image forming apparatus A according to the illustrated embodiment, as shown in FIG. 2, a jam treatment and the exchanging of the process cartridge can be performed by opening a front cover 14. Further, the jam treatment at the fixing device 13 and the sheet discharging portion can be performed by opening an upper cover 51 as an opening/closing member. That is to say, the image forming apparatus is of front operation type in which the operator handles the main body of the image forming apparatus at a front side F thereof (FIG. 1).

Further, as shown in FIG. 2, the upper cover 51 is supported by an L-shaped arm 57 rotatable around a rotation axis 56 and can be opened and closed by rotating the cover around the rotation axis 56.

(Sheet Discharging Apparatus)

Next, the sheet discharging apparatus will be described. As shown in FIG. 1, the sheet discharging apparatus B according to the illustrated embodiment is integrally incorporated into the image forming apparatus A and serves to discharge the sheet P to which the toner images were fixed by the fixing device 13 onto a discharge tray as a stacking portion by means of a pair of discharging rollers 53 constituting a discharging portion. In the illustrated embodiment, while an example that the sheet discharging apparatus is integrally incorporated into the image forming apparatus will be explained, the sheet discharging apparatus of the present invention may be applied to and optionally mounted to a sheet processing device having a sheet processing function such as a stapling function or a perforating function.

(Full-Stack Condition Detection Lever)

In the sheet discharging apparatus B according to the illustrated embodiment, there is provided a full-stack condition detection portion for detecting whether an amount of the sheets discharged onto the discharge tray 54 reaches a predetermined amount or not. The full-stack condition detection portion is designed so that a full-stack condition detection lever (referred to merely as "detection lever" hereinafter) 52 as a lever member rotatable around an axis 60 with respect to the upper cover 51 and a sensor (not shown) for detecting a predetermined position of the detection lever 52 are attached above the discharge tray 54.

By attaching the detection lever 52 to the opening/closing upper cover 51 in this way, a stay member or the like constituting a part of the detection lever 52 can be omitted. By omitting the stay member or the like, it can be prevented that a height of the image forming apparatus be increased and that an installation area of the image forming apparatus due to rearward extension of the discharge tray 54 be increased. Further, by omitting the stay member, since the stay member is not positioned above the discharge tray 54, it is easier to remove the sheets P1 on the discharge tray.

Figure 3:
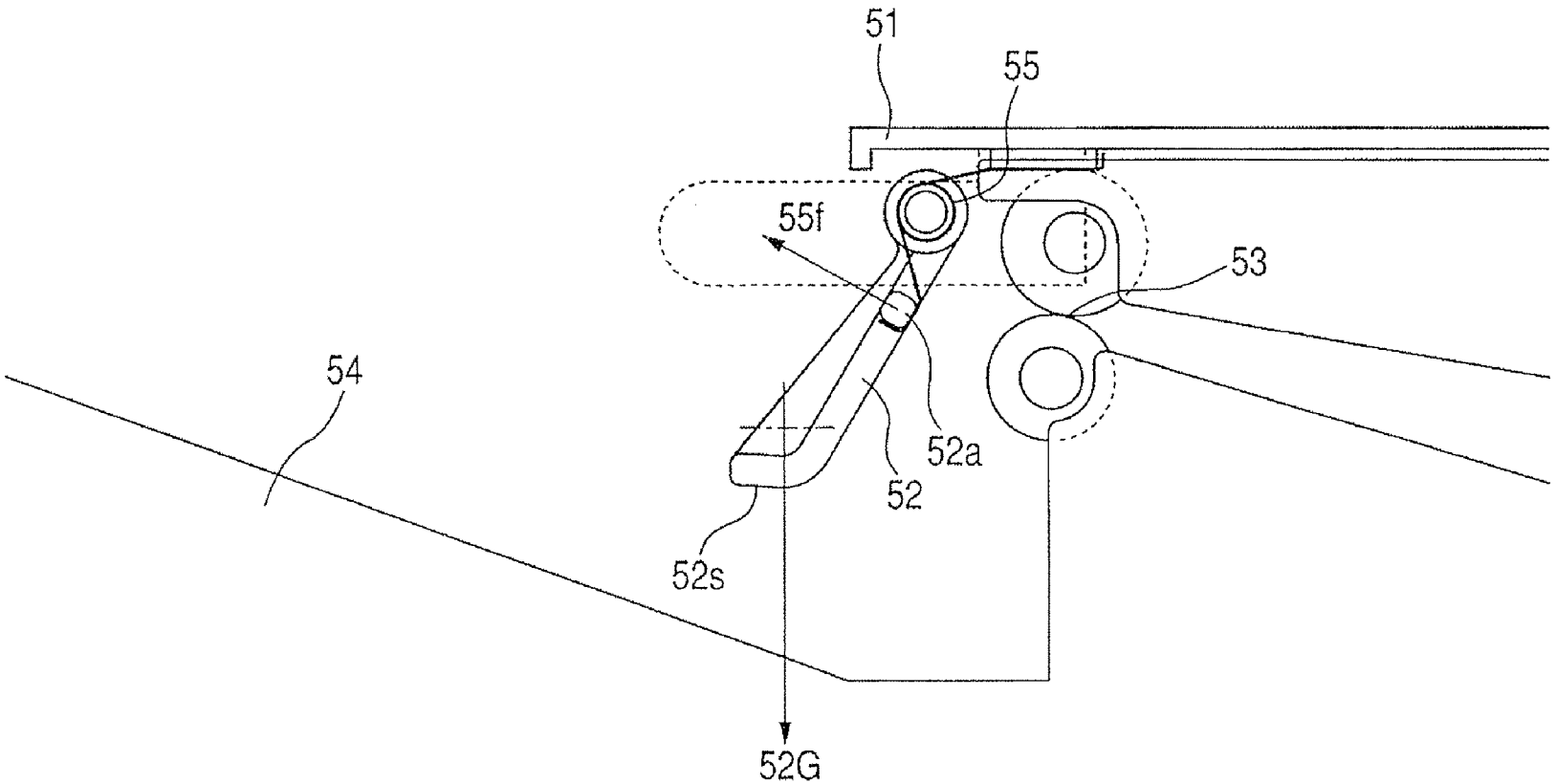
FIG. 3 is a schematic sectional view of a discharging portion of the image forming apparatus according to the first embodiment of the present invention.

As mentioned above, the detection lever 52 can be rotated around the axis 60. In a condition that the upper cover 51 is closed, as shown in FIG. 3, the detection lever 52 is locked by a stopper (not shown) so that the detection lever is maintained to have a predetermined angle with respect to a vertical direction along which the detection lever 52 is suspended by its own weight. Accordingly, in a print waiting condition in which the upper cover 51 is closed, the detection lever 52 cannot be rotated in an anti-clockwise direction but can be rotated in a clockwise direction from the position shown in FIG. 3. In this way, the detection lever 52 is set at a sheet detecting area where the detection lever can abut against the sheet discharged onto the discharge tray 54. In the illustrated embodiment, the sheet detecting area is situated between a position where the detection lever is locked by the stopper and a full-stack condition detecting position where the fact that an amount of the sheets discharged on the discharge tray 54 exceeds a predetermined amount is detected.

While the sheets are being discharged onto the discharge tray 54, when the amount of the sheets stacked on the discharge tray 54 reaches the predetermined amount, the detection lever 52 is pushed upwardly. In this case, by detecting the position of the detection lever 52 by means of an optical sensor or the like (not shown), the full-stack condition of the sheets stacked on the discharge tray 54 is detected.

Figure 4:
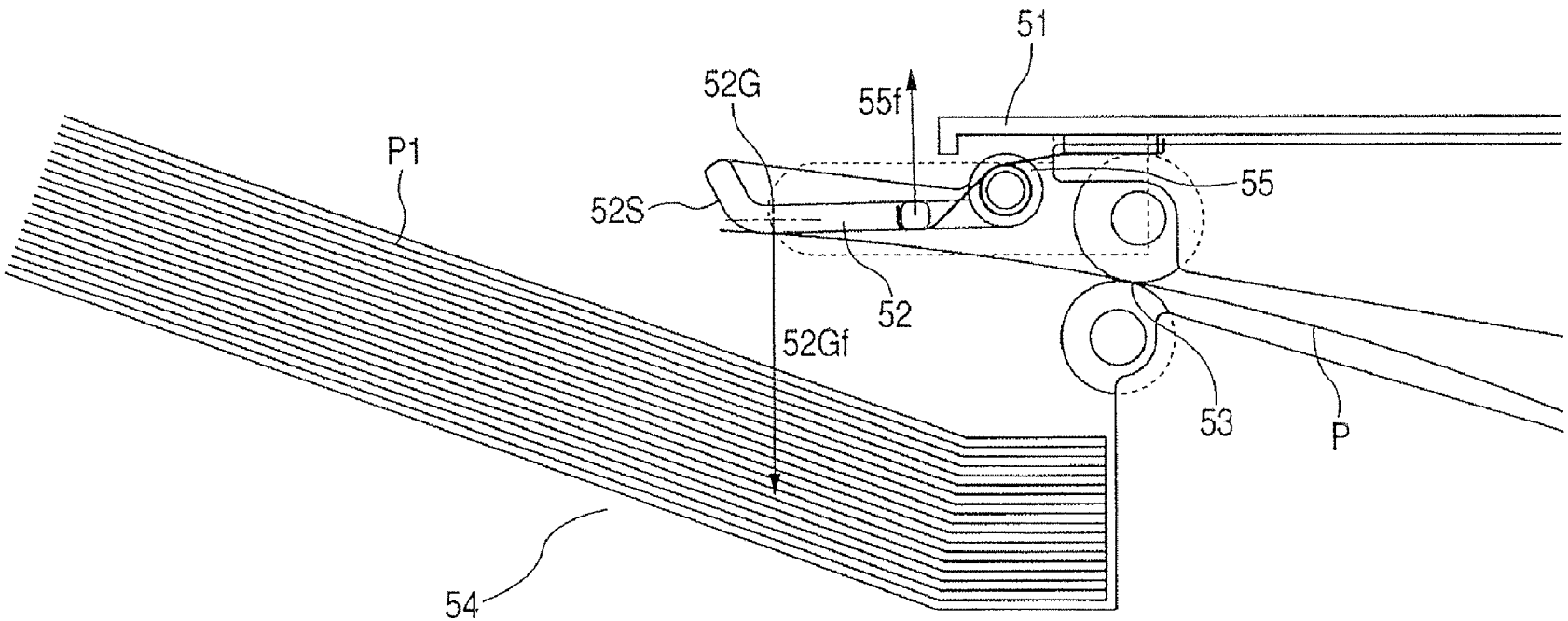
FIG. 4 is a schematic sectional view of the discharging portion during a discharging operation of the image forming apparatus according to the first embodiment of the present invention.

Further, during the sheet discharging, the detection lever 52 also acts as striking-down member for pushing the sheet being discharged by its own weight to positively strike the sheet down onto the discharge tray 54. That is to say, as shown in FIG. 4, the detection lever 52 is pushed upwardly by resiliency of the sheet P being discharged. In this case, the detection lever 52 tries to be returned to the posture shown in FIG. 3 from the condition shown in FIG. 4 by a rotational force caused by an own weight force 52G. By such own weight force 52G, the lever strikes-down a trailing end of the sheet P discharged by the pair of discharging rollers 53, thereby enhancing a sheet stacking-down ability of the discharge tray 54.

(Delay Mechanism for Detection Lever)

The sheet discharging apparatus B according to the illustrated embodiment is provided with a delay mechanism 55 for delaying the rotation of the detection lever 52 toward its suspended or vertical posture caused by its own weight when the upper cover 51 is rotated from its open position to its closed position.

As shown in FIG. 3, a torsion coil spring constituting the delay mechanism 55 is attached to the axis 60, and one end of the coil spring is locked to the upper cover 51 and the other end is locked to a locking portion 52*a* of the detection lever 52. Thus, the detection lever 52 is subjected to a biasing force 55*f* shown by the arrow in FIG. 3 to be biased toward the clockwise direction. That is to say, the delay mechanism 55 serves to bias the detection lever 52 toward a delaying direction, in opposition to the movement of the detection lever tending to be suspended by its own weight.

However, in the condition that the upper cover 51 is closed, it is set so that the biasing force for rotating the detection lever 52 in the clockwise direction by the biasing force 55*f* becomes smaller than the force for rotating the detection lever 52 in the anti-clockwise direction by the own weight force 52G of the detection lever. Thus, in the print waiting condition, as shown in FIG. 3, although the biasing force 55*f* acts on the detection lever 52, the detection lever is locked to the stopper (not shown) of the upper cover 51 by its own weight force 52G.

Further, during the sheet discharging, as shown in FIG. 4, the detection lever 52 is rotated up to the vicinity of a highest point and a twist angle of the torsion coil spring becomes smallest. Thus, the biasing force 55*f* of the delay mechanism 55 also becomes smallest. Further, since the detection lever 52 is situated at a position where the detection lever has greatest positional energy, the rotational force of the detection lever 52 caused by the own weight force 52G becomes greatest.

Thus, even if the biasing force 55*f* of the delay mechanism 55 acts on the detection lever 52 to rotate the detection lever in the direction opposite to the rotational direction caused by the own weight force 52G, the detection lever 52 biases the discharged sheet to positively strike-down the trailing end of the sheet.

(Movement of Detection Lever when Upper Cover is Closed)

Next, when the upper cover 51 is closed from the open condition, a relationship between the detection lever 52 and the delay mechanism 55 will be explained with reference to FIGS. 5A to 5C.

Figure 5A:
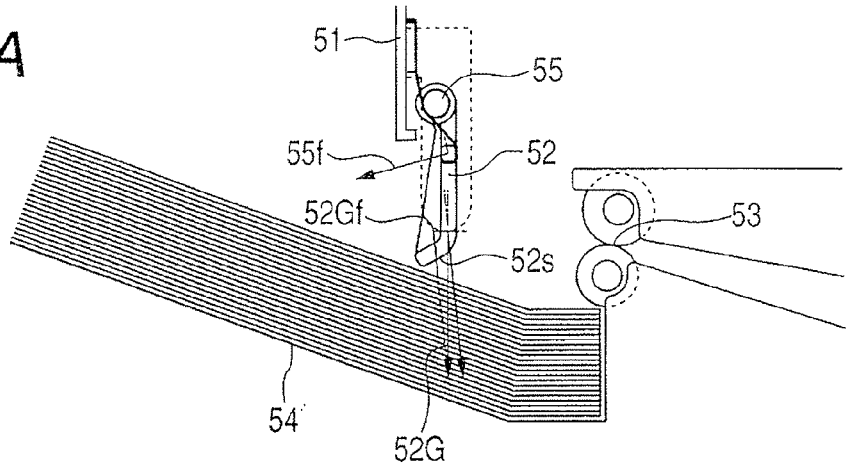
FIGS. 5A, 5B and 5C are schematic sectional views showing steps for closing an upper cover of the discharging portion of the image forming apparatus according to the first embodiment of the present invention.
Figure 5B:
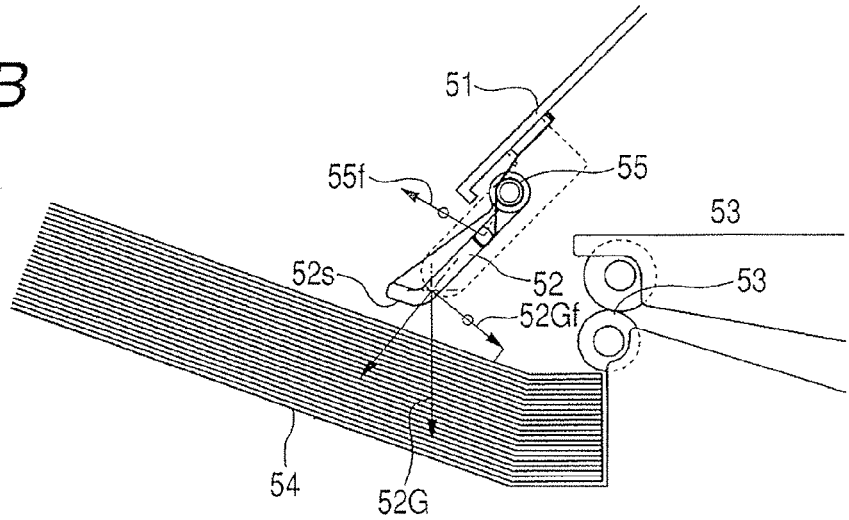

In the condition that the upper cover 51 is opened, as shown in FIG. 5A, the detection lever 52 is suspended in the vertical direction by the own weight force 52G. Further, in this case, the detection lever 52 is biased toward the clockwise direction by the biasing force 55*f* of the delay mechanism 55 and is stopped against a locking portion (not shown). In this case, a force component 52G*f* of the own weight force 52G directed toward the direction of the biasing force 55*f* acts along the same direction as the biasing force 55*f*. Thus, the own weight force 52G serves to increase the biasing force 55*f*, thereby biasing the detection lever 52 toward the clockwise direction to urge the lever against the locking portion (not shown).

As the upper cover 51 is closed, the detection lever 52 is rotated integrally with the upper cover 51 halfway by the action of the biasing force 55*f*. Thereafter, the force component 52G*f* (refer to FIG. 5B) of the own weight force 52G directed toward the biasing force 55*f* for the detection lever 52 acts along a direction opposite to the biasing force 55*f*. This force component 52G*f* acts as a force for rotating the detection lever 52 in the anti-clockwise direction in opposition to the biasing force 55*f* and is gradually increased as the upper cover 51 is closed. As shown in FIG. 5B, the detection lever 52 is rotated integrally with the upper cover 51 until the force component 52G*f* of the own weight force 52G becomes equal to the opposed biasing force 55*f*.

That is to say, when the upper cover 51 is closed, since the detection lever 52 is rotated integrally with the upper cover 51 up to the predetermined angle, the detection lever 52 is shifted while maintaining an adequate distance between the detection lever and the stacked sheets P1. As a result, the upper cover 51 can be closed smoothly. Further, since the detection lever 52 is not caught by the stacked sheets P1, damages of the upper cover 51 and the detection lever 52, scattering of the stacked sheets P1, and, scratching and breaking of the stacked sheet P1 can be prevented.

Figure 5C:
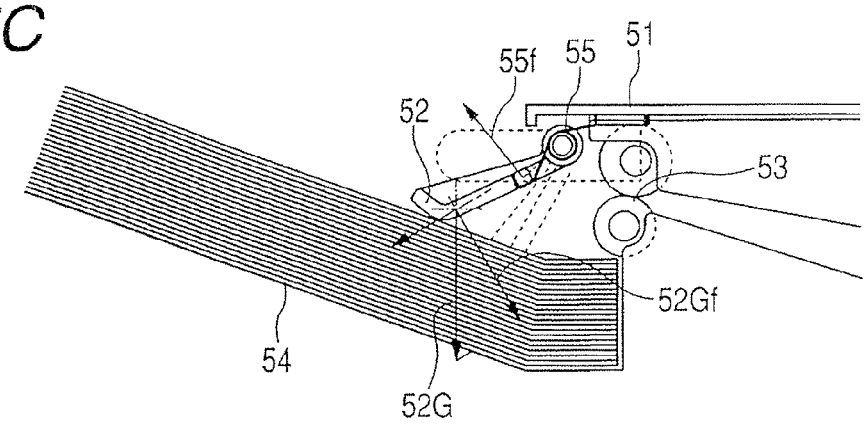

As the upper cover 51 is further closed, the lever rotational force generated by the force component 52G*f* of the own weight force 52G of the detection lever 52 gradually becomes greater than the biasing force 55*f* (refer to FIG. 5C). Thus, the detection lever 52 is rotated in the anti-clockwise direction by the lever rotational force generated by the own weight force 52G. In a condition that the upper cover 51 is completely closed as shown in FIG. 5C, the detection lever 52 is engaged by the stopper to maintain the predetermined angle with respect to the vertical direction and abuts against the upper surface of the sheet stack P1.

When the upper cover 51 is closed as mentioned above, since the biasing force 55*f* of the delay mechanism acts on the detection lever 52, the detection lever 52 is not caught by the stacked sheets. Incidentally, the delay mechanism is not limited to the particular construction such as the torsion coil spring so long as the delay mechanism can delay the rotation of the detection lever 52 caused by its own weight, and thus, a mechanism in which a load based on a friction force is applied to the detection lever during the rotation thereof or a mechanism utilizing a hydraulic damper may be used. Further, by devising a positional relationship between the axis 60 and the rotation axis 56, it is possible to eliminate the inconvenience that the detection lever 52 is caught by the stacked sheets to some extent. However, when the inclination of the discharge tray 54 and the thickness of the stacked sheets P1 are also considered, it is difficult to eliminate such inconvenience only by the positional relationship between the axis 60 and the rotation axis 56.

Further, in the illustrated embodiment, an inclined surface portion 52S is provided on a leading end of the detection lever 52. The inclined surface portion 52S is designed so that a relative angle between the stacked sheets P1 and the opposed leading end portion of the detection lever becomes smaller, in a condition of FIG. 5B in which the lever rotational force generated by the own weight of the detection lever 52 is balanced with the biasing force 55*f* of the delay mechanism 55.

By providing such an inclined surface portion 52S, the detection lever 52 can be retarded from the stacked sheets P1 more smoothly. Therefore, by utilizing both the inclined surface portion 52S provided on the leading end of the detection lever 52 and the delay mechanism 55, the function for preventing the fact that the detection lever 52 is caught by the stacked sheets P1 can be enhanced.

Figure 6:
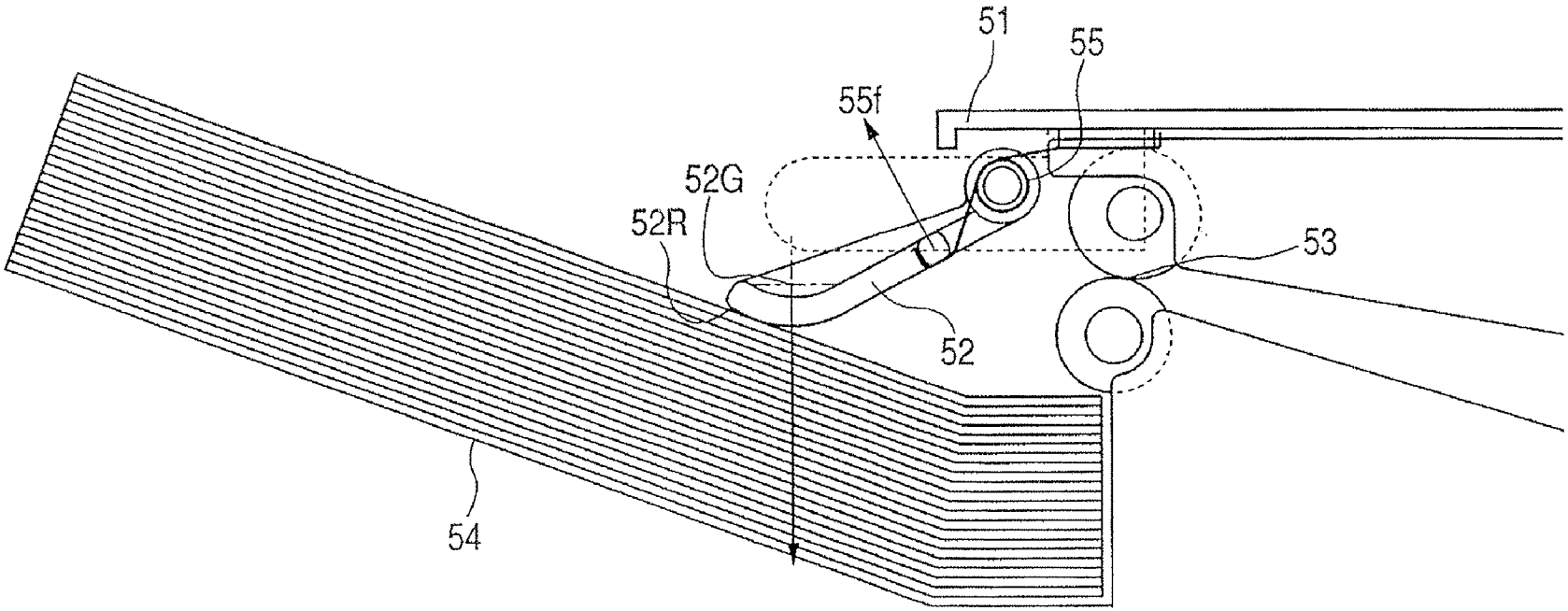
FIG. 6 is a schematic sectional view of a detection lever having a leading curved surface end portion according to the first embodiment of the present invention.

Further, in place of the provision of the inclined surface portion 52S at the leading end of the detection lever 52, as shown in FIG. 6, a curved surface portion 52R having a curved cross-section may be provided. Similar to the inclined surface portion 52S, since the curved surface portion 52R can reduce an angle between the stacked sheets P1 and a tangential line to the curved surface portion 52R, the same effect as mentioned above can be achieved.

Second Embodiment

Next, an example as a second embodiment in which a lever member is applied to a conveyance switching member for switching a path between a both-face conveying path and a discharge port will be explained with reference to FIGS. 7 and 8. Incidentally, elements having the same functions as those in the first embodiment are designated by the same reference numerals and duplicated explanation will be omitted.

Figure 7:
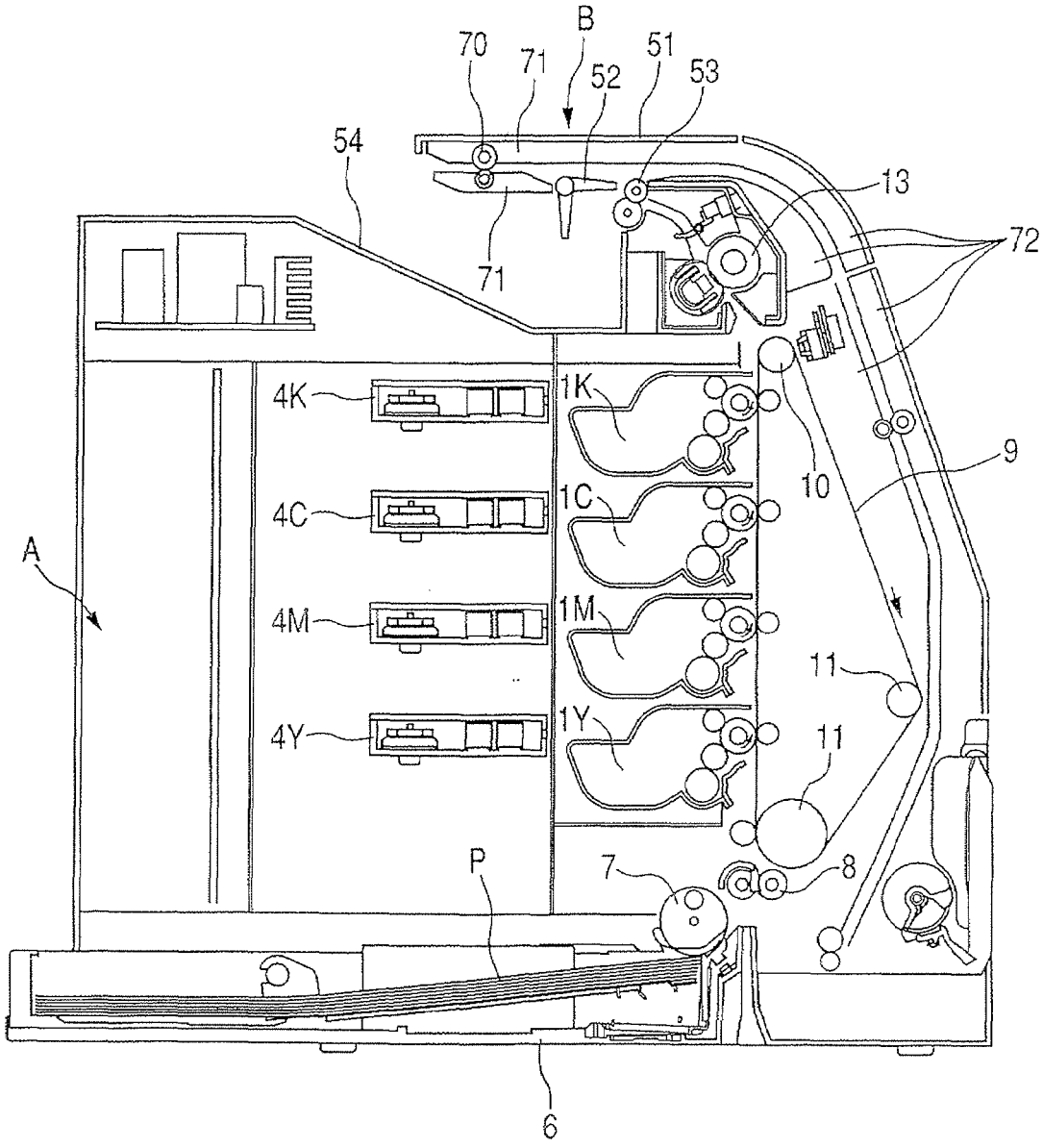
FIG. 7 is a schematic sectional view showing the entire main body of a color image forming apparatus according to a second embodiment of the present invention.
Figure 8A:
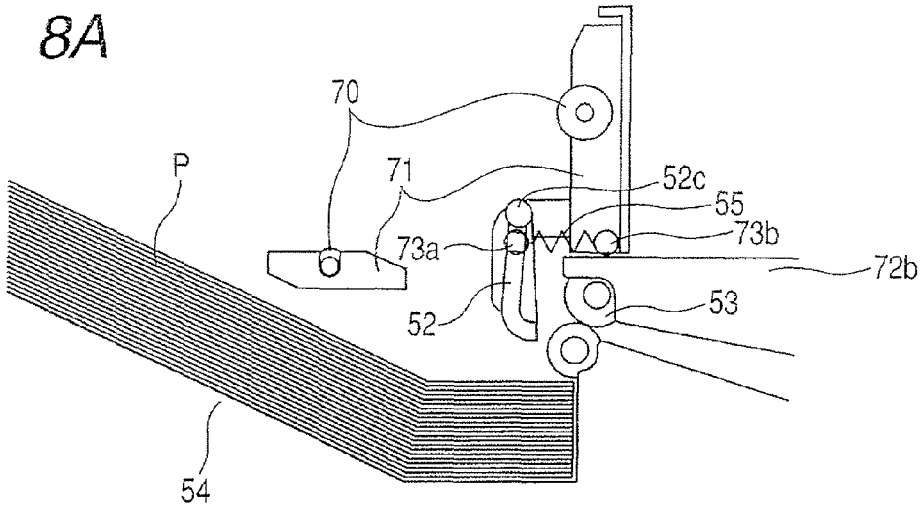
FIGS. 8A, 8B and 8C are schematic sectional views showing steps for closing an upper cover of a discharging portion of the image forming apparatus according to the second embodiment of the present invention.
Figure 8B:
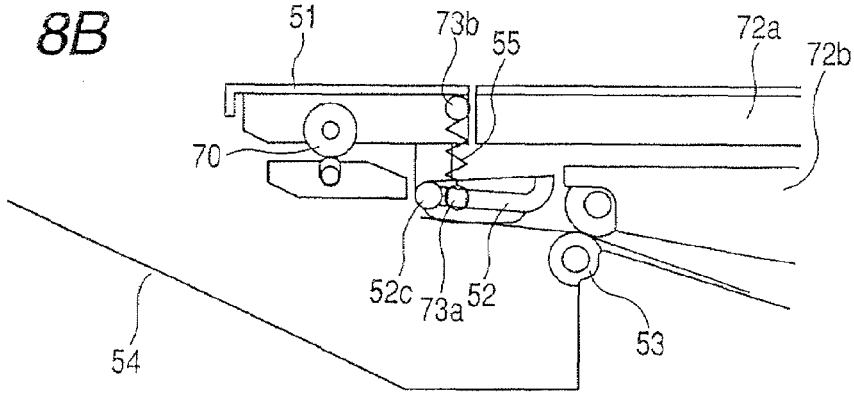
Figure 8C:
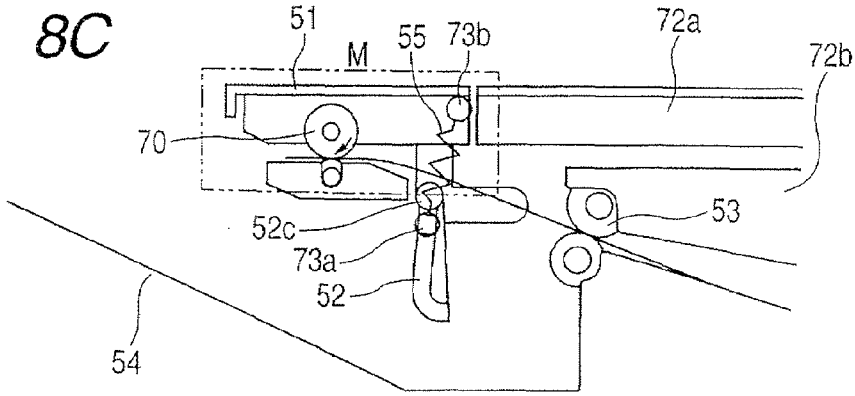
Figure 9:
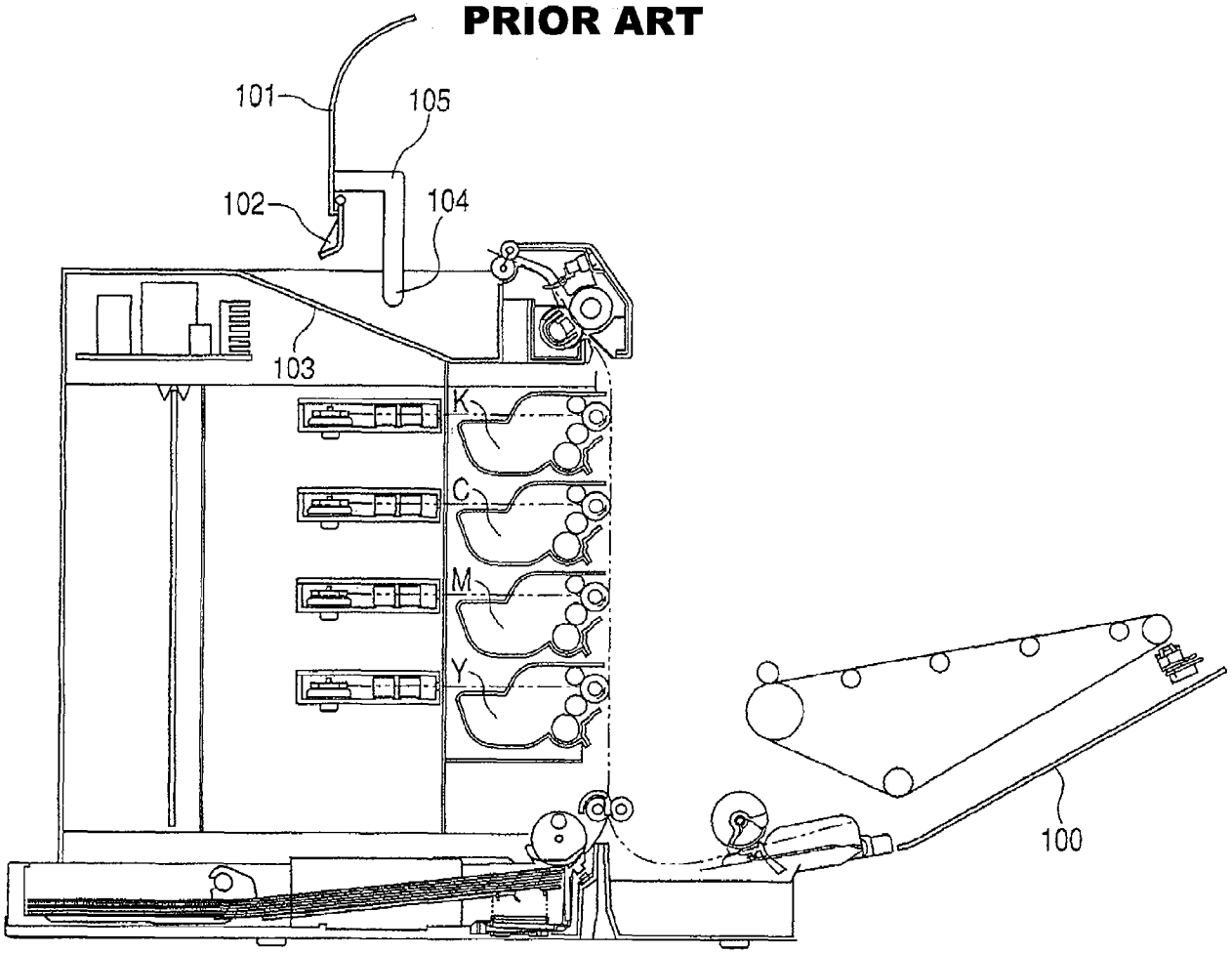
FIG. 9 PRIOR ART
FIG. 9 is a schematic sectional view showing a condition obtained when an opening/closing cover of a main body of a conventional color image forming apparatus is opened.
Figure 10:
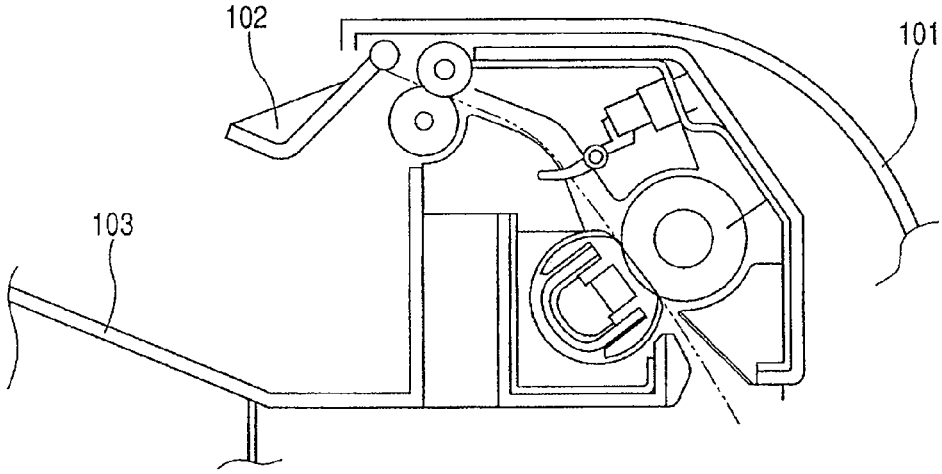
FIG. 10 PRIOR ART
FIG. 10 is a schematic sectional view showing a sheet full-stack condition detection lever of the main body of the conventional color image forming apparatus.
Figure 11A:
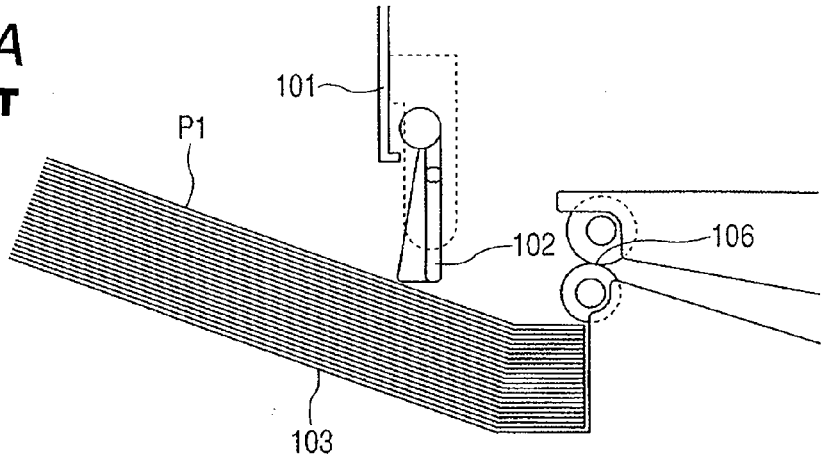
FIG. 11A PRIOR ART
FIGS. 11A, 11B and 11C are views showing steps for closing an upper cover of a discharging portion of the conventional color image forming apparatus.
Figure 11B:
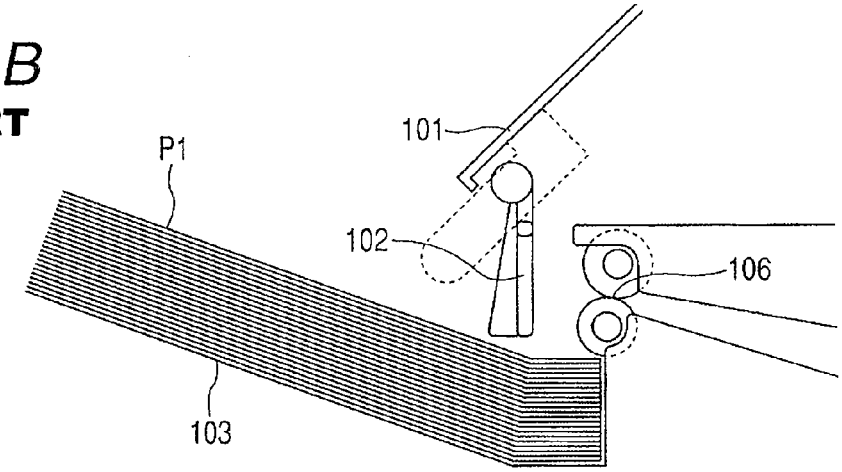
FIG. 11B PRIOR ART
Figure 11C:
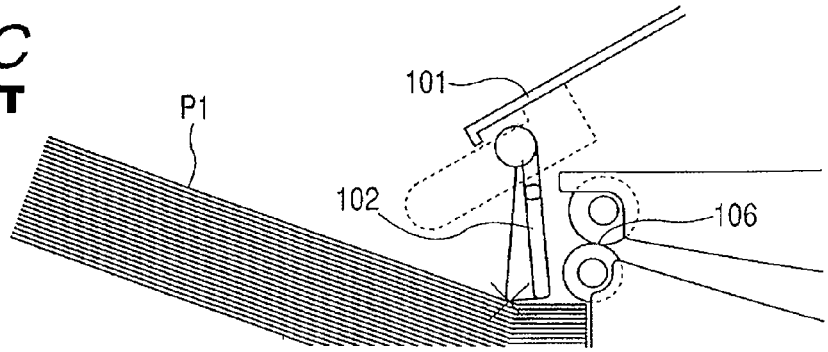
FIG. 11C PRIOR ART

FIG. 7 is a schematic sectional view of a main body of an image forming apparatus having a both-face recording function. Further, FIGS. 8A, 8B and 8C are schematic sectional views showing a main of an image forming apparatus in which a lever member is applied to a conveyance switching flapper for a sheet. Incidentally, FIG. 8A shows a condition that a cover is opened, FIG. 8B shows a discharging condition and FIG. 8C shows a both-face recording condition (condition that the cover is closed).

In the drawings, a conveyance switching flapper 52 (referred to merely as "flapper" hereinafter) as a conveyance switching member is provided for switching a conveying path for a sheet. The flapper 52 is rotatably attached to an upper cover 51 which is opened when a jam treatment is performed and constitutes a lever member in this embodiment.

Incidentally, there are provided a pair of both-face reverse rotation rollers 70 for switching a sheet P between a normal rotation and a reverse rotation during the recording, a both-face reverse rotation guide portion 71 for directing the sheet P into a nip portion of the pair of both-face reverse rotation rollers 70, and both-face conveying guides 72*a* and 72*b* for conveying the reversed or turned-over sheet by the both-face reverse rotation guide portion 71.

Now, a movement of the sheet P during the both-face recording will be explained with reference to FIGS. 8A, 8B and 8C. In case of one-face recording and/or when the sheet having both surfaces on which the images were recorded is discharged, as shown in FIG. 8B, the flapper 52 is rotated upwardly around an axis 52*c*. As a result, the sheet P passes below a lower surface of the flapper 52 and below a lower side of the both-face reverse rotation guide and is rested on the discharge tray. Incidentally, the upward rotation of the flapper 52 is performed by, for example, excitation of an electromagnetic unit such as a solenoid (not shown).

In case of the both-face recording, as shown in FIG. 8C, the flapper 52 is rotated downwardly around the axis 52*c* to open the both-face reverse rotation guide 71, with the result that the sheet P is introduced into the nip portion of the pair of both-face reverse rotation rollers 70.

In this case, the pair of both-face reverse rotation rollers 70 are rotated in a normal direction (i.e. direction shown by the arrow in FIG. 8C) and such normal rotation continues until a trailing end of the sheet P is conveyed to a both-face reverse rotation area M.

After the trailing end of the sheet P is conveyed to the both-face reverse rotation area M, the pair of both-face reverse rotation rollers 70 are rotated in a reverse direction (i.e. direction opposite to the direction shown by the arrow in FIG. 8C), with the result that the sheet is conveyed to a group of both-face conveying guides 72*a* and 72*b*. Subsequent operations are the same as the one-face recording operations. That is, the sheet is passed through the pair of registration rollers 8, various color transferring portions, fixing device 13 and pair of discharge rollers 53 and then passes below the upwardly retarded flapper 52 and then is discharged onto the discharge tray 54.

Next, a relationship between the opening/closing of the upper cover 51 and the flapper 52 will be explained. Incidentally, regarding the opening/closing of the upper cover 51, after a guide 72*a* also acting as an upper surface cover is opened, the upper cover 51 is opened, and, after the upper cover 51 is closed, the guide 72*a* is closed.

As mentioned above, the flapper 52 is rotatably attached to the upper cover 51. As shown in FIG. 8A, similar to the first embodiment, the upper cover 51 is supported by the L-shaped arm 57 (refer to FIG. 2) so that, when the upper cover 51 is opened around the rotation axis 56 (see FIG. 2), the flapper 52 is also lifted. In this case, a power source of the main body of the image forming apparatus is in an OFF condition and the flapper 52 is in a free rotatable condition with interruption of the driving force from the solenoid.

A tension spring is provided between a locking boss 73*a* of the flapper 52 and a locking boss 73*b* of the upper cover 51 and forms a part of a delay mechanism 55. A pulling force (biasing force) of the delay mechanism 55 for pulling the flapper 52 is set to pull the flapper 52 until the flapper is locked to a locking portion (not shown) when the upper cover 51 is in the open position as shown in FIG. 8A in a condition that the flapper 52 is in the free rotatable position. From this condition, as the upper cover 51 is shifted toward the closed position, the flapper 52 is rotated integrally with the upper cover 51 halfway by the pulling force of the delay mechanism 55 in opposition to the rotational force caused by the own weight of the flapper 52.

Thereafter, as the upper cover 51 is further closed, the rotational force caused by the own weight of the flapper 52 becomes greater than the pulling force of the delay mechanism 55, with the result that, as shown in FIG. 8C, the flapper 52 is lowered toward the discharge tray 54.

In this way, when the upper cover 51 is closed, since the flapper 52 is rotated integrally with the upper cover 51 halfway, similar to the first embodiment, the flapper is not caught by the sheets stacked on the discharge tray 54.

Incidentally, similar to the first embodiment, a curved surface portion is provided at a leading end of the flapper 52, so that the flapper is harder to be caught by the sheets stacked on the discharge tray 54.

In the above-mentioned embodiments, while an example that the torsion coil spring or the tension spring is used as a component constituting the delay mechanism was explained, the present invention is not limited to such an example, but, for example, any delay mechanism such as a hydraulic damper or a friction clutch, which delays the movement of the lever member toward the suspended condition by applying resistance against the rotation of the lever caused by its own weight, may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and function.

This application claims the benefit of Japanese Patent Application No. 2005-282424, filed Sep. 28, 2005, which is hereby incorporated by reference herein in its entirety.

What is claimed is:

1. A sheet discharging apparatus which discharges sheets to a stacking portion by a discharging portion, comprising:

an opening/closing member openable and closable with respect to a main body of said apparatus;

a lever member rotatably provided on said opening/closing member above the stacking portion and taking a suspended posture by its own weight according to said opening/closing member being closed; and a delay mechanism which delays a rotation of said lever member toward the suspended posture caused by the own weight of said lever member, by applying a biasing force in response to said opening/closing member being shifted from an open position to a completely closed position, wherein the biasing force is continuously applied by the delay mechanism to the lever member in a closing operation between the open position and the completely closed position.

2. A sheet discharging apparatus according to claim 1, wherein when said opening/closing member rotates from the open position to the completely closed position, said delay mechanism is urged against a rotational force of said lever member caused by the own weight of said lever member in a direction in which said lever member rotates integrally with said opening/closing member, from the open position to a position between the open position and the completely closed position.

3. A sheet discharging apparatus according to claim 2, wherein a force in which said delay mechanism is urged is smaller than the rotational force of said lever member caused by the own weight of said lever member in a condition that said opening/closing member is completely closed.

4. A sheet discharging apparatus according to claim 1, wherein said lever member abuts against an upper surface of the sheet stacked on the stacking portion in a condition that said opening/closing member is completely closed.

5. A sheet discharging apparatus according to claim 4, wherein said lever member is a full-stack condition detection lever.

6. A sheet discharging apparatus according to claim 1, wherein said lever member pushes down the sheet discharged by the discharging portion toward the stacking portion in a condition that said opening/closing member is completely closed.

7. A sheet discharging apparatus according to claim 1, wherein said lever member also acts as a conveyance switching member which switches a sheet conveying path in a condition that said opening/closing member is completely closed.

8. A sheet discharging apparatus according to claim 1, wherein a tip portion of said lever member has an inclined shape.

9. An image forming apparatus which forms an image on a sheet and discharges the sheet, comprising:

an image forming portion which forms an image on a sheet; and a sheet discharging apparatus which discharges sheets to a stacking portion by a discharging portion, comprising:

an opening/closing member openable and closable with respect to a main body of said image forming apparatus;

a lever member rotatably provided on said opening/closing member above the stacking portion and taking a suspended posture by its own weight according to said opening/closing member being closed; and a delay mechanism which delays a rotation of said lever member toward the suspended posture caused by the own weight of said lever member, by applying a biasing force in response to said opening/closing member being shifted from an open position to a completely closed position, wherein the biasing force is continuously applied by the delay mechanism to the lever member in a closing operation between the open position and the completely closed position.

10. An image forming apparatus according to claim 9, wherein when said opening/closing member rotates from the open position to the completely closed position, said delay mechanism is urged against a rotational force of said lever member caused by the own weight of said lever member in a direction in which said lever member rotates integrally with said opening/closing member, from the open position to a position between the open position and the completely closed position.

11. An image forming apparatus according to claim 10, wherein a force in which said delay mechanism is urged is smaller than the rotational force of said lever member caused by the own weight of said lever member in a condition that said opening/closing member is completely closed.

12. An image forming apparatus according to claim 9, wherein said lever member abuts against an upper surface of the sheet stacked on the stacking portion in a condition that said opening/closing member is completely closed.

13. An image forming apparatus according to claim 12, wherein said lever member is a full-stack condition detection lever.

14. An image forming apparatus according to claim 9, wherein said lever member pushes down the sheet discharged by said discharging portion toward the stacking portion in a condition that said opening/closing member is completely closed.

15. An image forming apparatus according to claim 9, wherein said lever member also acts as a conveyance switching member which switches a sheet conveying path in a condition that said opening/closing member is completely closed.

16. An image forming apparatus according to claim 9, wherein a tip portion of said lever member has an inclined shape.

17. An image forming apparatus according to claim 9, wherein a tip portion of said lever member has a curved shape.

18. A sheet discharging apparatus according to claim 1, wherein a tip portion of said lever member has a curved shape.

* * * * *